US009102142B2

(12) United States Patent
Gracia Verdugo et al.

(10) Patent No.: US 9,102,142 B2
(45) Date of Patent: Aug. 11, 2015

(54) METHOD OF CONTROLLING INKJET PRINTING

(71) Applicant: HEWLETT-PACKARD DEVELOPMENT COMPANY, L.P., Houston, TX (US)

(72) Inventors: Antonio Gracia Verdugo, Barcelona (ES); Gonzalo Gaston Liado, Barcelona (ES); Marina Cantero Lazaro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 234 days.

(21) Appl. No.: 13/753,651

(22) Filed: Jan. 30, 2013

(65) Prior Publication Data

US 2014/0210889 A1 Jul. 31, 2014

(51) Int. Cl.

| | |
|---|---|
| ***B41J 29/38*** | (2006.01) |
| ***B41J 2/07*** | (2006.01) |
| ***B41J 2/21*** | (2006.01) |
| ***B41J 2/045*** | (2006.01) |

(52) U.S. Cl.

CPC *B41J 2/07* (2013.01); *B41J 2/0456* (2013.01); *B41J 2/0458* (2013.01); *B41J 2/0459* (2013.01); *B41J 2/04561* (2013.01); *B41J 2/04581* (2013.01); *B41J 2/04591* (2013.01); *B41J 2/2142* (2013.01)

(58) Field of Classification Search

CPC ..... B41J 2/07; B41J 2/16579; B41J 2/393; B41J 2/1433; B41J 2/0451; B41J 2/04551

USPC ..... 347/14, 19

See application file for complete search history.

(56) References Cited

U.S. PATENT DOCUMENTS

| | | | | |
|---|---|---|---|---|
| 6,361,137 | B1 | 3/2002 | Eaton | |
| 6,629,747 | B1 | 10/2003 | King | |
| 2003/0081040 | A1 * | 5/2003 | Therien et al. | 347/19 |
| 2006/0066656 | A1 | 3/2006 | Maher | |
| 2014/0002521 | A1 * | 1/2014 | Kim et al. | 347/10 |
| 2014/0184675 | A1 * | 7/2014 | Tamaki | 347/9 |

FOREIGN PATENT DOCUMENTS

| | | |
|---|---|---|
| JP | 2012101499 | 5/2012 |
| WO | WO-2012044307 | 4/2012 |

* cited by examiner

*Primary Examiner* — Alessandro Amari
*Assistant Examiner* — Alexander C Witkowski
(74) *Attorney, Agent, or Firm* — Hewlett-Packard Patent Department

(57) ABSTRACT

A method of controlling inkjet printing including firing at least one fluid drop from an inkjet printhead at one or more firing frequencies; measuring a parameter of said fired at least one fluid drop to determine a present firing performance of the inkjet printhead at each of the one or more firing frequencies; determining if the present firing performance at any of the one or more firing frequencies is different from a predetermined firing performance; and changing, in accordance with a difference between the present firing performance and the predetermined firing performance, and for at least one of the one or more firing frequencies, a fluid quantity parameter for subsequent fluid drops to be fired by the printhead.

16 Claims, 4 Drawing Sheets

METHOD OF CONTROLLING INKJET PRINTING

BACKGROUND

Inkjet printing mechanisms fire drops of ink onto a print medium to generate an image. Such mechanisms may be used in a wide variety of applications, including computer printers, plotters, copiers, and facsimile machines. An inkjet printing apparatus may include a printhead having a plurality of independently addressable firing units. Each firing unit may include a fluid chamber connected to a fluid source and to a fluid outlet nozzle. A transducer within the fluid chamber provides the energy for firing fluid drops from the nozzles. In thermal inkjet printers, the transducers are thin-film resistors that generate sufficient heat during application of a voltage pulse to vaporize a quantity of fluid. This vaporization is sufficient to fire a fluid drop.

It is known to control drop quantity for inkjet printing of colored inks, for example by comparing the color of a calibration pattern printed on a print medium with a desired color output. This comparison can be useful to compensate for deterioration of a printhead over time, for example due to kogation. However, such techniques cannot be used for a colorless fluid, such as a pretreatment fluid for improving the fixing of a colored ink to the print medium, to reduce image quality defects.

BRIEF DESCRIPTION OF THE DRAWINGS

The accompanying drawings illustrate examples of the principles described herein and are a part of the specification. The illustrated examples are merely examples and do not limit the scope of the claims.

DETAILED DESCRIPTION

In the following description, for purposes of explanation, numerous specific details are set forth in order to provide a thorough understanding of the present apparatus and methods. It will be apparent, however, to one skilled in the art that the present apparatus, systems and methods may be practised without these specific details. Reference in the specification to "an example" or similar language means that a particular feature, structure, or characteristic described in connection with the example is included in at least that one example, but not necessarily in other examples.

Figure 1:
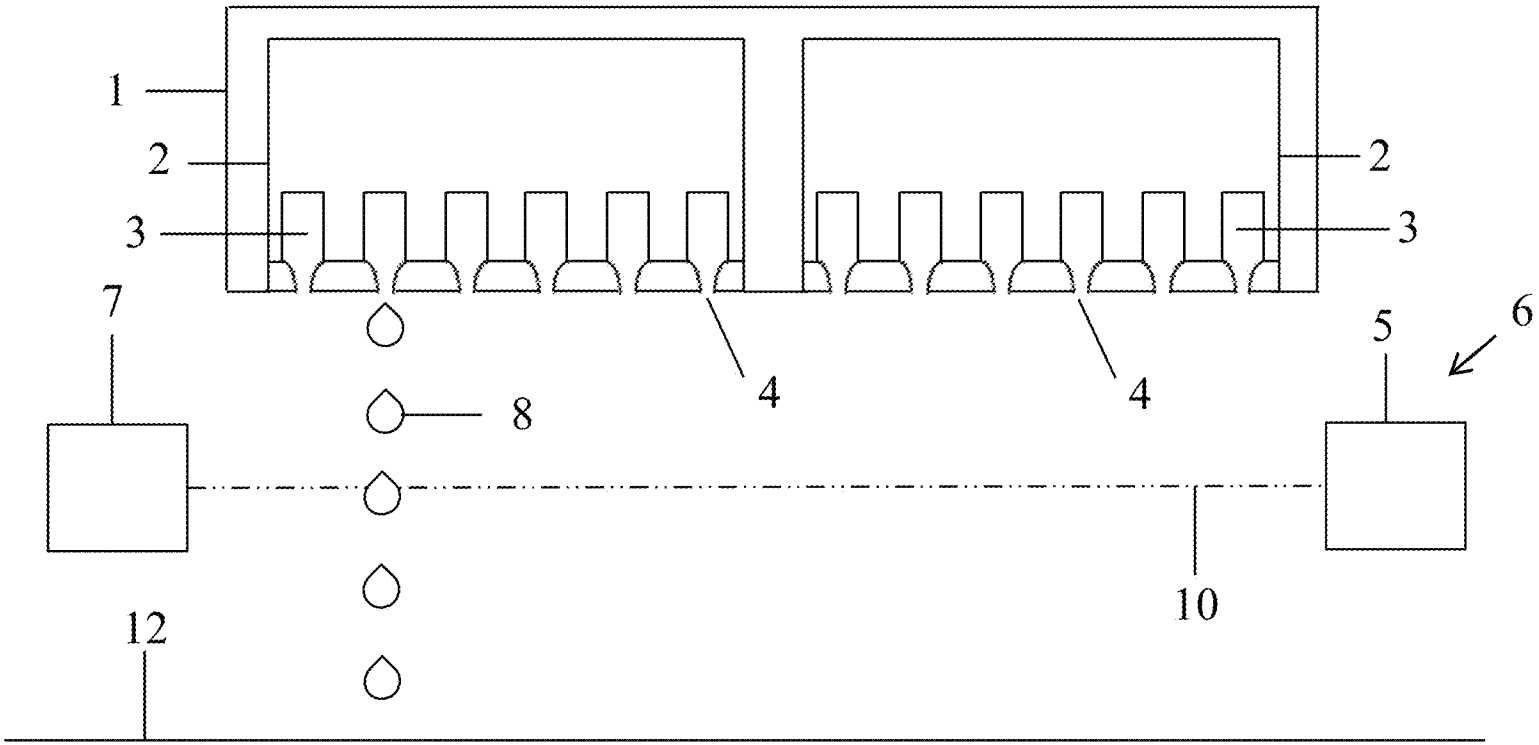
FIG. 1 shows schematically an example of parts of an inkjet printing apparatus.

FIG. 1 shows schematically an example of parts of an inkjet printing apparatus for performing a method of examples described later. In this example, the inkjet printing apparatus 1 comprises a plurality of inkjet printheads 2. In other examples the apparatus may comprise one printhead.

In this example, the inkjet printhead 2 comprises a plurality of orifices, which are nozzles 4 in this example, for example 1056 nozzles per printhead, for firing at least one fluid drop of for example an ink or of a pretreatment fluid. Each nozzle 4 is connected to a separate fluid chamber 3, which receives fluid from a fluid source (not shown). In some examples, each fluid chamber 3 may be connected to a separate fluid source; in other examples, a plurality of fluid chambers 3 share a fluid source, for example of an ink of a particular color.

In an example of inkjet printing apparatus comprising a plurality of printheads, the common fluid source of a printhead is shared among a plurality of printheads; in other examples, each printhead has its own common fluid source for the plurality of nozzles such that each printhead can be used to print with a different fluid.

Each fluid chamber 3 comprises a transducer, which in an example of a thermal inkjet printer is a thin-film resistor for heating the fluid in the fluid chamber. In the example of a piezoelectric inkjet printer, the transducer is a piezoelectric transducer. As is known to the skilled person, in order to print, fluid is transferred from the fluid source to a fluid chamber. A voltage pulse is applied to the transducer, which creates a pressure pulse in the fluid in the chamber, causing a fluid drop 8 to be fired from the nozzle 4 connected to the chamber and towards a print medium 12, for example paper.

A series of voltage pulses can be applied to the transducer at a certain frequency, referred to as the firing frequency, to fire at least one fluid drop from the inkjet printhead, in this case from the nozzle, at this firing frequency. By controlling the width and amplitude of each voltage pulse, the quantity of fluid in each fired fluid drop can be controlled; for example, increasing the amplitude or width of an applied voltage pulse will increase the quantity of fluid in a fired fluid drop.

The printing apparatus shown in FIG. 1 also comprises a drop detector 6 arranged to measure a parameter of at least one fluid drop fired by the printhead, for example a fluid drop velocity. A drop detector may, for example, comprise a light source 5 for producing a collimated beam of light 10 incident on a photodetector 7 at a certain distance from the light source 5; fired fluid drops crossing the light beam will interrupt the light, for example by absorbing and/or scattering the light, thus changing the amount of light incident on the photodetector, allowing the position of a fired fluid drop when in flight to be identified. An example drop detector such as this may allow the fluid drop velocity to be determined by measuring the flight time taken between the firing of the fluid drop from a nozzle and the time the fluid drop is detected, and knowing the distance between the nozzle and the light beam. Drop detectors such as this may be used to measure a parameter of at least one fluid drop fired by one or a plurality of nozzles. An example of a suitable drop detector is given in International Patent Publication No. WO 2012/044307.

Figure 2:
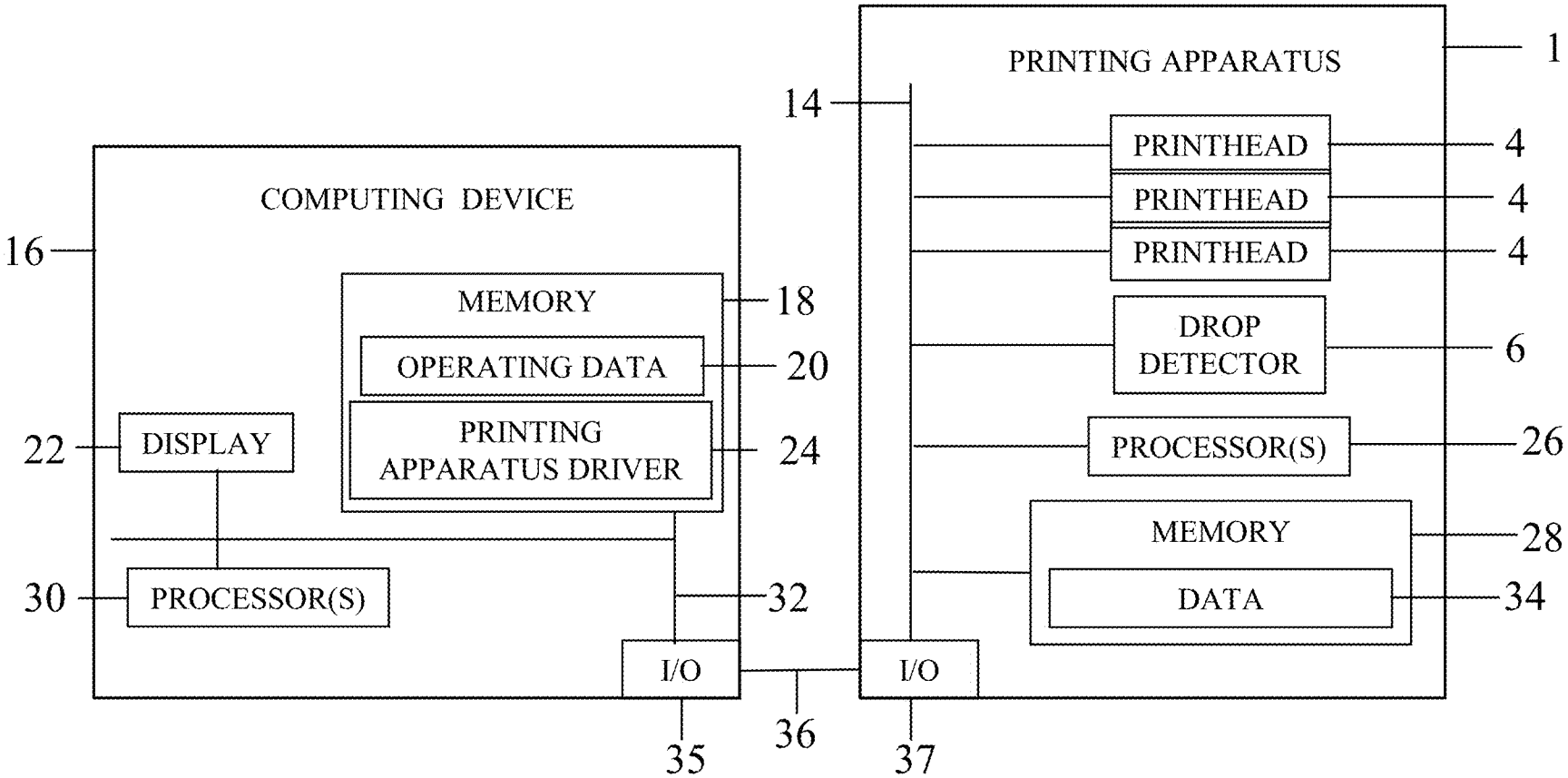
FIG. 2 shows schematically an example of apparatus for controlling an inkjet printing apparatus.

FIG. 2 shows schematically an example of further features of the printing apparatus 1 and in this example a computing device connected to the printing apparatus. The printing apparatus comprises: the inkjet printheads 2 for firing at least one fluid drop; the drop detector 6; at least one processor 26; memory 28 such as a volatile memory or a non-volatile memory, and an input/output (I/O) interface 37. These components may be interconnected using a systems bus 14. Data 34, for example data relating to the desired image to be printed and data indicative of a calibration of the printing apparatus may be stored in the memory 28.

The printing apparatus 1 is connected 36 via for example an Ethernet or a Universal Serial Bus (USB) connection to an example computing device 16 comprising: memory 18, which may comprise volatile memory such as Random Access Memory (RAM), non-volatile (NV) memory such as a magnetic medium drive, solid state drive (SSD) and/or Read Only Memory (ROM); a display 22; one or more processors 30 and an I/O interface 35. The components of the computing device may be interconnected using a systems bus 32. The computing device may be controlled by a user with input devices such as a keyboard and a point control device such as a mouse. Computer software, for example a printing apparatus driver 24, for use operating the printing apparatus 1 may be stored in the memory 18. Operating data 20, for example for operating the computing device, such as Microsoft® Windows 7, may also be stored in the memory 18. The computing device may further comprise a communications interface (not shown) such as an Ethernet port for communicating with for example another computing device over a communications network such as the Internet, or a local area network (LAN). In other examples it is appreciated that features of the computing device may be incorporated in the printing apparatus, so that a separate computing device may not be required to operate the printing apparatus.

The memory of the printing apparatus and/or of the computing device may also include computer program instructions, i.e. computer software, configured to, with the at least one processor, cause the inkjet printing apparatus to perform a method of controlling inkjet printing of examples described herein. Further, there may be provided a computer program product comprising a non-transitory computer-readable storage medium, for example a memory described above, having computer readable instructions stored thereon, the computer readable instructions being executable by a computerized device to cause the computerized device to perform a method for controlling inkjet printing in accordance with examples described herein.

To print, the computing device may, using the printer apparatus driver 24, send image data to the printing apparatus via the connection 36. This image data may be processed using the processor(s) 26 and the memory 28 of the printing apparatus to generate signals for driving at least one of the printheads to move relative to a print medium such as paper and to fire at least one fluid drop onto the print medium. Such signals for controlling fluid drop firing are sent to the thin-film resistor of at least one fluid chamber, and may include voltage pulses with an amplitude, width and timing selected to determine the frequency and fluid quantity of the fired at least one fluid drop to be controlled.

The data 34 stored in the memory 28 of the printing apparatus 1 may include a linearization table for translating input image data, for example image data received from the computing device 16, encoding the desired image, to output data for controlling firing of the printheads in accordance with the image encoded by the input image data. For example, the output data may indicate a fluid drop weight to be fired for a given image data input. The linearization table may therefore include data indicative of a calibration of the printing apparatus for a given image data input. A linearization table may be used when there is a non-linear relationship between input image data and output data. For example, a linear relationship would require a 50% increase in output fluid quantity for an increase of 50% in input image data; a non-linear relationship requires an increase in output fluid quantity of either more or less than (but not equal to) 50% for an increase of 50% in input image data. Further details of use of a linearization table according to examples described herein will be given further below.

Within the printing apparatus 1, the memory 28 may also store data 34 received from the drop detector 6, for example data indicative of a measured parameter of a fired fluid drop, and data indicative of a relationship between the measured parameter and firing frequency, for use in examples to be described below.

In the devising of examples described herein, it has been realized that inkjet printing of a substantially colorless fluid, such as a pretreatment fluid, may be controlled using a relationship between a measured parameter of at least one fired fluid drop, such as fluid drop velocity, and the firing frequency of the at least one fluid drop. Thus, the quality of printed images may be improved, as the quantity of pretreatment fluid applied to a printing medium may be more accurately controlled. Thus, effects caused by an incorrect amount of pretreatment fluid being applied to a printing medium, for example due to deterioration of the printhead over its lifetime, may be reduced or eliminated. Such effects include for example: bleed, where the boundaries between different colored inks printed on the applied pretreatment fluid are blurred; and coalescence, which occurs when wet ink drops of colored inks of different colors come into contact with each other when applied to the medium.

It is to be appreciated that known methods for controlling inkjet printing of a colored ink, for example using a printed colored pattern for calibration, are redundant for control of printing a substantially colorless fluid. In contrast, the method of examples described herein provides an effective method of controlling inkjet printing of a substantially colorless fluid. Moreover, it has been realized that the method of examples described herein may also be used to control inkjet printing of a colored fluid such as an ink, i.e. a fluid comprising a liquid vehicle with a pigment suspended therein and/or a dye dissolved therein. Thus, the method of examples described herein is versatile and may be used to provide a simple technique to control inkjet printing of fluids, whether they are colored or not.

The term "substantially colorless" used herein for a fluid is defined to mean that the fluid has a total absorption, reflection and emission of light in the visible light spectrum of 390 to 700 nanometers (nm) of less than 5% for light incident on the fluid. The term "colored fluid" used herein is defined to mean that the fluid has a total absorption, reflection and emission of light in the visible light spectrum of 390 to 700 nanometers (nm) of 5% or greater.

Figure 3:
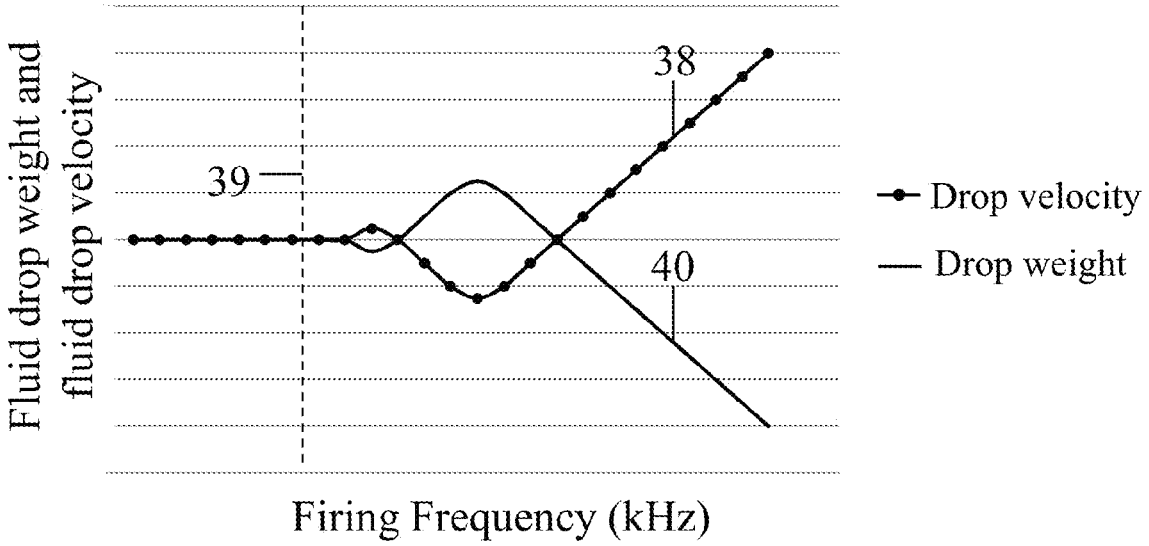
FIG. 3 shows schematically an example of a relationship between fluid drop weight and fluid drop velocity as a function of firing frequency.

FIG. 3 shows schematically an example of a relationship between a fluid drop parameter, in this example fluid drop velocity 38, and a fluid quantity parameter, in this example fluid drop weight 40, as a function of firing frequency, for at least one fluid drop fired by a printhead such as that described above. As shown, as the firing frequency increases, both the fluid drop weight 40 and the fluid drop velocity 38 remain constant up to a threshold frequency 39. Then, as an observed phenomenon, once the firing frequency increases above the threshold frequency 39, the fluid drop weight 40 and the fluid drop velocity 38 change from their constant values, and diverge from each other with a decrease in fluid drop weight 40 corresponding to an increase in fluid drop velocity 38. With a continuing increase in firing frequency, the fluid drop weight and fluid drop velocity converge, thus with the fluid drop weight increasing and the fluid drop velocity decreasing, until a point that the fluid drop weight and fluid drop velocity diverge again. Thus, above the threshold the drop velocity and drop weight inversely correlate with each other.

Over the lifetime of the printhead, the quantity of fluid ejected from the printhead for a given voltage pulse at a certain firing frequency may change. This is because, for example, fluid residues may accumulate in the fluid chamber of a printhead, thus reducing the quantity of fluid ejected from the printhead by obstructing the path of ink from the fluid chamber through the nozzle. Also, for example, the thin-film resistors controlling drop production within a printhead may wear out, thus affecting the quantity of fluid ejected. In addition, due to a process called kogation, a scale may form on top of the resistors, causing separation of the fluid from the resistors, leading to irregular fluid ejection.

The relationship described using FIG. 3 may be used to detect a change in a parameter, such as fluid drop weight, of at least one fired fluid drop, which for example is caused by kogation. This will be explained using the example illustrated in FIG. 4.

Figure 4:
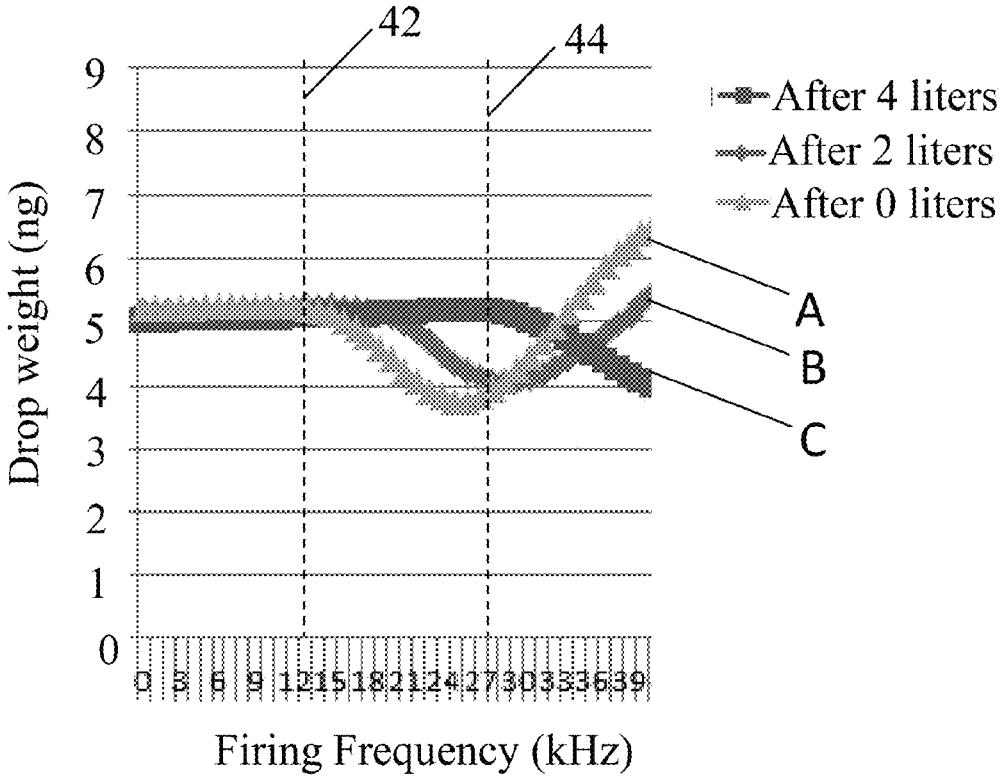
FIG. 4 shows an example plot of the drop weight as a function of firing frequency after firing different quantities of a fluid.

FIG. 4 shows schematically the relationship between fluid drop weight in nanograms (ng) as a function of the firing frequency in kiloHertz (kHz). For each of the plot lines A, B and C, the voltage pulses sent to the printhead are intended to fire fluid drops of a constant drop weight of 5 ng over a range of firing frequencies; however, as shown by the different plot lines, the relationship between actual fluid drop weight of fired drops and the firing frequency changes over the lifetime of the printhead; thus, the actual drop weight fired may not correlate with the intended drop weight. A first plot line A corresponds to fluid drops each of 5 ng fired when a printhead has fired a total of 0 liters cumulatively by the nozzles; a second plot line B corresponds to fluid drops each of 5 ng fired when a printhead has cumulatively fired a total of 2 liters by the nozzles; and a third plot line C corresponds to fluid drops each of 5 ng fired when a printhead has cumulatively fired a total of 4 liters by the nozzles. As can be seen from FIG. 4, as the amount of fluid having been fired by a printhead increases over the lifetime of the printhead, there is an apparent increase in the firing frequency corresponding with the frequency threshold above which the fluid drop weight is no longer constant. Although not shown, the fluid drop velocity also remains constant up to the threshold, in accordance with the relationship shown in FIG. 3. In this example, a first threshold frequency 42 is approximately 14 kHz when 0 liters of fluid have been fired; once 2 liters have been fired the threshold corresponds to a frequency of approximately 18 kHz (not shown) and when 4 liters have been fired the threshold frequency 44 is 28 kHz; each of these threshold frequencies shown in FIG. 4 represents the mean threshold frequency over all of the nozzles.

The reason for the apparent increase in the maximum firing frequency at which the drop weight remains constant, which corresponds with the threshold, is due to a decrease in fluid drop weight over the lifetime of the printhead, for example due to kogation. Therefore, the perceived change in frequency threshold is indicative of the change in fluid drop weight and therefore of a firing performance of at least one nozzle, which in turn can be used to change the fluid drop quantity of subsequently fired drops, to compensate for the decrease of drop weight over the printhead lifetime. Examples of methods using this principle will now be described.

Figure 5:
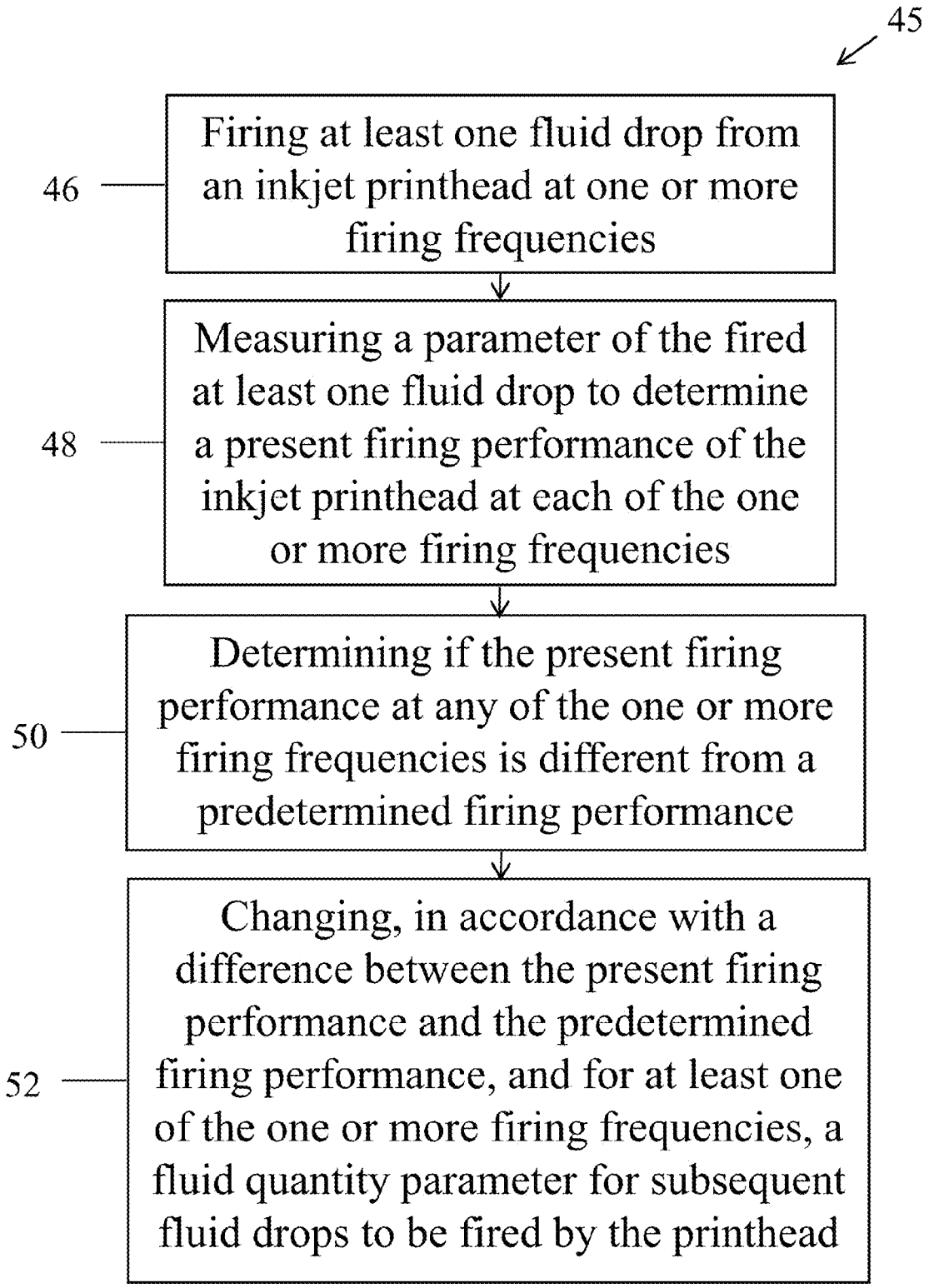
FIG. 5 is a flow diagram showing steps of a method according to an example.

FIG. 5 is a flow diagram showing steps of a method 45 of controlling inkjet printing, according to examples, including:

a) firing at least one fluid drop from an inkjet printhead at one or more firing frequencies;

b) measuring a parameter of said fired at least one fluid drop for determining a present firing performance of the inkjet printhead at each of the one or more firing frequencies;

c) determining if the present firing performance at any of the one or more firing frequencies is different from a predetermined firing performance; and d) changing, in accordance with a difference between the present firing performance and the predetermined firing performance, and for at least one of said one or more firing frequencies, a fluid quantity parameter for subsequent fluid drops to be fired by the printhead.

This method 45 may be implemented using the printing apparatus described above, and will now be described in more detail, with reference to FIG. 5. First, examples will be described for one nozzle; then examples will be described for a plurality of nozzles of a printhead. The examples may be used for a substantially colorless fluid such as a pretreatment fluid or a colored fluid such as an ink, either of which may be for example selected from the Hewlett Packard Company (3000 Hanover Street, Palo Alto, Calif. 94304-1185, USA) Scitex PT range of printing fluids/inks for use in for example a Hewlett Packard DesignJet printer.

Step a) 46 includes firing at least one fluid drop from an inkjet printhead at one or more firing frequencies; for example a series of 5 drops may be fired from one or each of a plurality of nozzles at each of a plurality of firing frequencies such as 2, 4, 6, 8, 10, 12, 14, 16, 18, 20, 22, 24, 26, 28 and 30 kHz.

Step b) 48 includes measuring a parameter of the fired at least one fluid drop to determine a present firing performance of a nozzle of the printhead at each of the one or more plurality of firing frequencies. The performance of one or each of a plurality of nozzles may indicate a present firing performance of the inkjet printhead. In this example, the measured parameter is the fluid drop velocity, which is measured by the drop detector for each of the at least one fired fluid drops. Where for example a series of 5 drops is fired per frequency, a mean velocity may for example be calculated for each frequency. Data indicative of a measured fluid drop velocity, for example the mean value for each frequency, may be stored in the memory 28 of the printing apparatus.

In this example, the method includes determining the present firing performance of the nozzle, which is indicative of a firing performance of the inkjet printhead, using a fluid drop quantity value determined using a relationship between the measured parameter, for example the fluid drop velocity of the fired at least one drop, and the firing frequency.

The present firing performance may be determined by using the relationship and principles described above using FIGS. 3 and 4. Therefore, from the data of the measured fluid drop velocity for different frequencies, a change in fluid drop velocity indicates a change in fluid drop weight and therefore also the frequency of the threshold above which the fluid drop velocity and weight values begin to diverge. This threshold frequency is indicative of the present firing performance of the nozzle. In an example, the data indicative of the fluid drop velocity for each frequency may be processed to identify the threshold frequency above which firing performance begins to deteriorate.

In step c), it is determined whether the present firing performance at any of the one or more firing frequencies is different from a predetermined firing performance of the nozzle. The predetermined firing performance may for example indicate a desired fluid drop weight at a particular firing frequency, so that quality printing is obtained. The predetermined firing performance may be indicated by data indicative of a firing frequency threshold above which firing performance deteriorates, and/or data indicative of a fluid drop velocity and/or a fluid drop weight for each of one or a plurality of firing frequencies. Data indicative of the predetermined firing performance may be stored in the memory 28 of the printing apparatus.

The predetermined firing performance may be determined at any time prior to the time at which the present firing performance is determined. In some examples, the predetermined firing performance may be determined when a new printhead is inserted into the printing apparatus, to give an indication of the printhead firing performance before any fluid has been fired (other than that to determine the predetermined performance), and before any undesirable effects, such as kogation, have started occurring.

According to an example, determining if the present firing performance at any of the one or more firing frequencies is different from a predetermined firing performance includes comparing data indicative of the present firing performance with data indicative of the predetermined firing performance. The comparison may for example be undertaken by the processor(s) of the printing apparatus, using firing performance data stored in the memory. For example, the threshold frequency of the present firing performance may be compared with the threshold frequency for the predetermined firing performance, or in other examples data indicative of fluid drop velocity and/or fluid drop weight for the present firing performance may be compared with data indicative of fluid drop velocity and/or fluid drop weight for the predetermined firing performance, for at least some of the plurality of firing frequencies.

In some examples, step c) of the method may include comparing the present firing performance with a predetermined firing performance; using the comparison to determine a compensation value indicative of the difference between the present firing performance and the predetermined firing performance; and using the compensation value to change the fluid quantity parameter in step d) for the inkjet printhead to fire subsequent fluid drops at the predetermined firing performance. The fluid drop quantity parameter may be for example a fluid drop weight parameter, a firing frequency parameter and/or a parameter indicative of a number of fluid drops to be applied at a location on a print medium, so that a desired fluid quantity is applied to a given location on a print medium.

Therefore, on the basis of the comparison, data indicative of a change in fluid drop quantity for subsequent firings may be determined, to compensate for the deterioration in fluid drop quantity for a given firing pulse over the lifetime of the printhead, so that the present printing performance may be changed to be closer to or the same as the predetermined printing performance. The extent of compensation needed will depend on the extent of the difference between present and predetermined firing performances. The compensation value may for example be used to modify data indicative of the quantity of fluid to be fired per drop by the nozzle. For example, the compensation value may be used to modify data values in a linearization table stored in the memory of the printing apparatus. For example, if a compensation value of 5% has been calculated, a fluid drop weight at a given frequency indicated in a linearization table may be increased by 5% to achieve the predetermined firing performance. The change of the linearization table value may cause a modified amplitude and/or width of a voltage pulse for firing a fluid drop. Further, or alternatively, a firing frequency may be adjusted by controlling the frequency of the voltage pulses applied to the thin-film resistor, as described above; and/or a number of fluid drops to be applied at a location on a print medium may be controlled by changing the printhead control instructions to increase the number of passes a printhead makes over a given location of the print medium. Further details of modifying a linearization table are explained further below.

This is an example of, in step d) 52, the method 45 including changing, in accordance with a difference between the present firing performance and the predetermined firing performance, and for at least one of one or more firing frequencies, a fluid quantity parameter for subsequent fluid drops to be fired by the printhead.

The examples of the method 45 described above may be applied to one nozzle in a printhead individually or to each of a plurality of nozzles of a printhead. Thus, where the inkjet printhead comprises a plurality of nozzles, the method may comprise performing steps a), b), c) and d) for one or more of said plurality of nozzles, for example for all of the nozzles of a printhead.

Examples will now be described for controlling inkjet printing of a pretreatment fluid for a plurality of nozzles. In those examples, features described previously are to be applied unless indicated otherwise, although further examples are envisaged which do not apply at least some of the features described previously. In other examples, the methods may be used to control printing of a colored ink.

In step a) of this example, the method includes firing at least one fluid drop at a plurality of firing frequencies for each of a plurality of nozzles.

In step b) of this example, a parameter of the fired at least one fluid drop may be measured to determine a present firing performance of each nozzle. For example, the drop detector may be used to measure a fluid drop velocity for a series of fired fluid drops, for each of the plurality of firing frequencies, for each nozzle. A present firing performance for each nozzle may then be determined for example in the manner described above; an average present firing performance may then be determined for the printhead by for example determining a mean present firing performance value over all the nozzles. In other examples, the present firing performance may be indicated by a proportion of the nozzles of a printhead for which at least one fired fluid drop is detected by the drop detector at each of the plurality of firing frequencies. In other words, if a fluid drop has a lower than desired drop weight, the drop velocity may be higher (in view of the relationship shown in FIG. 3), and the drop detector may not be able to detect that fluid drop, for example as the drop velocity may be too high. Therefore, data may be collected which is indicative of the proportion of nozzles of a printhead for which at least one fired fluid drop is detected, over a range of firing frequencies. Table 1 shows an example of such data, in this example for a pretreatment fluid, after 4 liters of fluid has been fired cumulatively by the nozzles of the printhead. As can be seen, the proportion of nozzles of the printhead for which fluid drops are detected decreases above a firing frequency of 6 kHz.

TABLE 1

| Firing frequency (kHz) | % nozzles detected |
|---|---|
| 2 | 100 |
| 4 | 100 |
| 6 | 100 |
| 8 | 95 |
| 10 | 90 |
| 12 | 85 |
| 14 | 80 |
| 16 | 75 |
| 18 | 70 |
| 20 | 65 |
| 22 | 55 |
| 24 | 40 |
| 26 | 20 |
| 28 | 10 |
| 30 | 20 |

Table 2 shows an example of data indicative of the proportion of nozzles of a printhead for which at least one fired fluid drop is detected by the drop detector for a series of drops at each of the plurality of firing frequencies, after the printhead has fired 0 liters (other than the fluid required to obtain the data in Table 2). The data in table 2 in this example is indicative of a predetermined firing performance of the printhead. It can be seen that the firing frequency above which the proportion of nozzles for which fluid drops are detected decreases is 14 kHz. This is higher than the present firing performance shown in Table 1, due to deterioration of the printhead for the data of Table 1.

TABLE 2

| Firing frequency (kHz) | % nozzles detected |
|---|---|
| 2 | 100 |
| 4 | 100 |
| 6 | 100 |
| 8 | 100 |
| 10 | 100 |
| 12 | 100 |
| 14 | 100 |
| 16 | 95 |
| 18 | 85 |
| 20 | 75 |
| 22 | 65 |
| 24 | 50 |
| 26 | 40 |
| 28 | 30 |
| 30 | 20 |

In the above tables, the column entitled "% nozzles detected" indicates the proportion of nozzles of a printhead for which at least one fired fluid drop is detected by the drop detector. The detectability of fluid drops, e.g. the range of fluid velocities that can be detected, will depend on the type of drop detector used.

In this example, the method comprises performing the steps a), b), c) and d) of the method 45 for each of one or more of the plurality of nozzles. Further, in this example, the method includes determining a proportion of the plurality of nozzles of a printhead having a present firing performance different from a predetermined firing performance, and using the proportion to determine a compensation value for changing in step d) the fluid quantity parameter for subsequent fluid drops to be fired by the printhead.

As an example, the proportion of the plurality of nozzles of a printhead having a present firing performance different from a predetermined firing performance may be determined by comparing the data of table 1 against the data of table 2.

In accordance with step d), the compensation value may be determined for each firing frequency so that subsequent fluid drops to be fired have a firing performance closer to or in accordance with the predetermined firing performance. There may be a different compensation value for each firing frequency. For example, at a frequency of 8 kHz, the proportion of nozzles of a printhead with at least one fired fluid drop being detected is 5% less after 4 liters of fluid have been fired than after 0 liters. The compensation value may therefore be determined to change a fluid drop quantity parameter to restore the proportion of nozzles to 100% detection.

Table 3 indicates in the third column an example of an increase of the fluid quantity parameter, for example a fluid drop weight, that needs to be fired by the nozzles of a printhead for a given frequency in order to increase the proportion of detected nozzles to 100%, thus compensating for deterioration of the printhead. The increase of the fluid quantity parameter in this example is the same for each nozzle, so that although some nozzles may perform better than others, the mean increase in firing performance across all nozzles achieves the predetermined firing performance. The data of Table 1 is included in the first two columns of Table 3.

TABLE 3

| Firing frequency (kHz) | % nozzles detected | % more fluid |
|---|---|---|
| 2 | 100 | 0 |
| 4 | 100 | 0 |
| 6 | 100 | 2 |
| 8 | 95 | 7 |
| 10 | 90 | 15 |
| 12 | 85 | 19 |
| 14 | 80 | 23 |
| 16 | 75 | 25 |
| 18 | 70 | 30 |
| 20 | 65 | 33 |
| 22 | 55 | 40 |
| 24 | 40 | 50 |
| 26 | 20 | 50 |
| 28 | 10 | 50 |
| 30 | 20 | 50 |

In some examples, data in a linearization table may be modified using the compensation value, so that the fluid quantity parameter such as fluid drop weight may be changed for subsequently fired drops, to compensate for deterioration of the printhead over its lifetime.

Therefore, if the present firing performance of an inkjet printhead at any of a plurality of firing frequencies is different from a predetermined firing performance, as determined in step c) of the method, a linearization table may be modified to adjust a fluid quantity parameter such as fluid drop weight for subsequent fluid drops to be fired by the printhead.

As the skilled person will appreciate, a linearization table may be used to control printing in inkjet printing apparatus, for translating input image data indicative of Contone input values, for example for each of a cyan ink (C), magenta ink (M), yellow ink (Y), black ink (K), and pretreatment fluid (P), to linearized output data corresponding to the quantity of each ink and the quantity of the pretreatment fluid to be fired by the printhead. In other examples a linearization table may indicate printing parameter values for one fluid to be printed.

Table 4 shows an example of a linearization table for a printing apparatus for a firing frequency of 8 kHz. Each row corresponds to Contone values which represent the quantity of fluid to be printed and range from a minimum of 0 to a maximum of 255. A Contone value of 0 represents firing zero fluid from a nozzle and a Contone value of 255 represents firing the maximum quantity of fluid from a nozzle, with values between 0 and 255 representing firing an intermediate quantity of fluid. It is noted that for simplicity only some example rows are shown; intermediate rows not shown are indicated using " . . . ". For the example of a color printer, changing the quantity of each ink color fired from a nozzle allows different color images to be printed. For example, to print a cyan image, a maximum quantity of cyan ink may be fired from each nozzle and no magenta, yellow or black ink would be fired from each nozzle. This would correspond to Contone values of 255 for cyan and 0 for magenta, yellow and black. There may be further linearization tables for other firing frequencies, print media and printing modes such as a number of passes over a location on a printing medium.

TABLE 4

| Input image data (C, M, Y, K, P) | Linearized output data (C, M, Y, K, P) |
|---|---|
| 0, 0, 0, 0, 0 | 0, 0, 0, 0, 0 |
| . . . | . . . |
| 125, 125, 125, 125, 125 | 100, 100, 100, 100, 42 |
| . . . | . . . |
| 255, 255, 255, 255, 255 | 180, 180, 180, 180, 80 |

The linearization table above (Table 4) may be modified to compensate for the difference between the present firing performance and the predetermined firing performance at a firing frequency of 8 kHz. As Table 3 indicates, at a firing frequency of 8 kHz, the voltage signals for firing the pretreatment fluid from the printhead need to cause a 7% greater quantity of fluid to be fired by the nozzles than would have been fired when the printhead had fired 0 liters, to compensate the present firing performance to reach the predetermined firing performance.

Table 5 shows the compensated values of the linearized output data for the pretreatment fluid. It can be seen that the value 42 of Table 4 has been increased by 7% to 45 in Table 5.

TABLE 5

| Input image data (C, M, Y, K, P) | Linearized output data (C, M, Y, K, P) |
|---|---|
| 0, 0, 0, 0, 0 | 0, 0, 0, 0, 0 |
| ... | ... |
| 125, 125, 125, 125, 125 | 100, 100, 100, 100, 45 |
| ... | ... |
| 255, 255, 255, 255, 255 | 180, 180, 180, 180, 86 |

In examples given above, at least one fluid drop is fired at a plurality of firing frequencies, for determining and compensating a present firing performance for at least one of the frequencies. In other envisaged examples, the methods described above may be performed for one firing frequency, for example if a printing apparatus is only intended to operate at one firing frequency.

The preceding description has been presented to illustrate and describe examples of the principles described. This description is not intended to be exhaustive or to limit these principles to any precise form disclosed. Many modifications and variations are possible in light of the above teaching, within the scope of the appended claims.

The invention claimed is:

1. A method of controlling inkjet printing including:

for each respective nozzle of a plurality of nozzles of an inkjet printhead, firing fluid drops from the respective nozzle at one or more firing frequencies, measuring a parameter of the fired fluid drops for determining a corresponding present firing performance of the respective nozzle at each of the one or more firing frequencies, determining if the corresponding present firing performance at any of the one or more firing frequencies is different from a predetermined firing performance;

determining a proportion of the plurality of nozzles having corresponding present firing performances different from the predetermined firing performance;

determining, using the proportion of the plurality of nozzles having corresponding present firing performances different from the predetermined firing performance, a compensation value; and using the compensation value, changing for at least one of the one or more firing frequencies, a fluid quantity parameter for subsequent fluid drops to be fired by the inkjet printhead.

2. A method according to claim 1, wherein measuring the parameter of the fired fluid drops is performed when the fluid drops are in flight.

3. A method according to claim 2, wherein measuring the parameter of the fired fluid drops is performed using a drop detector.

4. A method according to claim 3, wherein the measured parameter of the fired fluid drops comprises a fluid drop velocity.

5. A method according to claim 1, wherein determining the corresponding present firing performance of the respective nozzle uses a relationship between the measured parameter of the fired fluid drops and firing frequency.

6. A method according to claim 5, wherein the measured parameter of the fired fluid drops comprises a fluid drop velocity, which, using the relationship, is indicative of a fluid drop weight of the fired fluid drops.

7. A method according to claim 1, wherein determining if the corresponding present firing performance is different from the predetermined firing performance comprises comparing the corresponding present firing performance with the predetermined firing performance.

8. A method according to claim 1, wherein the fluid quantity parameter for the subsequent fluid drops is indicative of at least one of: a fluid drop weight, a firing frequency, and a number of fluid drops to be applied at a location on a print medium.

9. A method according to claim 1, wherein the fluid quantity parameter for firing the subsequent fluid drops is indicative of a fluid drop weight, and the changing includes changing a fluid drop weight parameter for the inkjet printhead to fire the subsequent fluid drops at the predetermined firing performance.

10. A method according to claim 9, wherein the changing includes changing at least one data value of the fluid quantity parameter in a linearization table that translates input image data to output data that controls the inkjet printhead.

11. A method according to claim 1, wherein the fluid drops are selected from among substantially colorless fluid drops, pretreatment fluid drops, colored fluid drops, or ink drops.

12. A printing apparatus comprising:

an inkjet printhead comprising a plurality of nozzles;

at least one processor; and at least one memory including computer program instructions executable by the at least one processor to:

for each respective nozzle of the plurality of nozzles, control firing of fluid drops at least one fluid drop from the respective nozzle at one or more firing frequencies, receive a measured parameter of the fired fluid drops for determining a corresponding present firing performance of the respective nozzle at each of the one or more firing frequencies;

determine if the corresponding present firing performance at any of the one or more firing frequencies is different from a predetermined firing performance;

determine a proportion of the plurality of nozzles having corresponding present firing performances different from the predetermined firing performance;

determine, using the proportion of the plurality of nozzles having corresponding present firing performances different from the predetermined firing performance, a compensation value; and using the compensation value, change for at least one of the one or more firing frequencies, a fluid quantity parameter for subsequent fluid drops to be fired by the inkjet printhead.

13. A printing apparatus according to claim 12, wherein the measured parameter comprises a fluid drop velocity.

14. A printing apparatus according to claim 12, wherein the changing of the fluid quantity parameter comprises updating a linearization table that translates input image data to output data that controls printing by the inkjet printhead.

15. A non-transitory computer-readable storage medium having computer readable instructions stored thereon, the computer readable instructions being executable by a computerized device to:

control firing of fluid drops from an inkjet printhead at one or more firing frequencies;

receive a measured parameter of the fired fluid drops for determining a present firing performance of the inkjet printhead at each of the one or more firing frequencies;

determining if the present firing performance at any of the one or more firing frequencies is different from a predetermined firing performance, wherein the present firing performance is indicated by a present threshold frequency at which change in fluid drop weight with increasing firing frequency diverge from change in fluid drop velocity with increasing firing frequency, and the predetermined firing performance is indicated by a predetermined threshold frequency, and wherein the determining comprises comparing the present threshold frequency to the predetermined threshold frequency; and changing, in accordance with a difference between the present firing performance and the predetermined firing performance, and for at least one of the one or more firing frequencies, a fluid quantity parameter for subsequent fluid drops to be fired by the inkjet printhead.

16. A non-transitory computer-readable storage medium according to claim 15, wherein the inkjet printhead includes a plurality of nozzles, and wherein the controlling, the receiving, and the determining are performed for each nozzle of the plurality of nozzles, and wherein the computer readable instructions are executable by the computerized device to:

determine a proportion of the plurality of nozzles having corresponding present firing performances different from the predetermined firing performance; and compute a compensation value using the proportion, wherein the changing of the fluid quantity parameter uses the compensation value.

* * * * *

UNITED STATES PATENT AND TRADEMARK OFFICE

CERTIFICATE OF CORRECTION

PATENT NO. : 9,102,142 B2
APPLICATION NO. : 13/753651
DATED : August 11, 2015
INVENTOR(S) : Antonio Gracia Verdugo et al.

It is certified that error appears in the above-identified patent and that said Letters Patent is hereby corrected as shown below:

In the Claims

In column 12, line 42, in Claim 12, delete "drops at least one fluid drop" and insert -- drops --, therefor.

Signed and Sealed this
Twenty-eighth Day of June, 2016

Michelle K. Lee

Michelle K. Lee
*Director of the United States Patent and Trademark Office*